US007260919B1

(12) United States Patent
Spransy et al.

(10) Patent No.: US 7,260,919 B1
(45) Date of Patent: Aug. 28, 2007

(54) SEALABLE CEILING ASSEMBLY

(75) Inventors: Peter J. Spransy, Salt Lake City, UT (US); Don A. Kugath, Draper, UT (US); Ronald H. Bushman, Salt Lake City, UT (US)

(73) Assignee: DAW Technologies, Inc., Salt Lake City, UT (US)

( * ) Notice: Subject to any disclaimer, the term of this patent is extended or adjusted under 35 U.S.C. 154(b) by 201 days.

(21) Appl. No.: 10/414,821

(22) Filed: Apr. 16, 2003

Related U.S. Application Data

(60) Provisional application No. 60/372,950, filed on Apr. 16, 2002, provisional application No. 60/378,336, filed on May 7, 2002.

(51) Int. Cl.
*E04B 2/00* (2006.01)

(52) U.S. Cl. ..... 52/586.1; 52/586.2; 52/585.1; 52/655.1; 52/653.1

(58) Field of Classification Search ..... 52/506.01, 52/506.03–506.09, 578, 582.1, 586.1, 586.2, 52/585.1, 653.1, 655.1; 403/230
See application file for complete search history.

(56) References Cited

U.S. PATENT DOCUMENTS

| | | | | | |
|---|---|---|---|---|---|
| 876,985 | A | * | 1/1908 | Name not available | 52/585.1 |
| 3,261,625 | A | * | 7/1966 | Cripe | 403/173 |
| 3,333,387 | A | * | 8/1967 | Donald | 52/664 |
| 3,451,183 | A | * | 6/1969 | Lespagnol et al. | 52/656.1 |
| 3,559,357 | A | * | 2/1971 | Lowe | 52/282.4 |
| 3,733,759 | A | * | 5/1973 | Schulte et al. | 52/126.4 |
| 3,748,793 | A | * | 7/1973 | Tompkins et al. | 52/64 |
| 3,832,816 | A | * | 9/1974 | Jahn | 52/779 |
| 3,837,128 | A | * | 9/1974 | O'Brien | 52/241 |
| 3,884,002 | A | * | 5/1975 | Logie | 52/285.2 |
| 3,989,399 | A | * | 11/1976 | Slowbe | 403/245 |
| 4,047,342 | A | * | 9/1977 | Boulva | 52/239 |
| 4,094,113 | A | * | 6/1978 | Good | 52/222 |
| 4,128,983 | A | * | 12/1978 | Matsubara | 52/731.5 |
| 4,299,067 | A | * | 11/1981 | Bertschi | 52/127.12 |
| 4,545,168 | A | * | 10/1985 | Dalton, Jr. | 52/586.1 |
| 4,944,129 | A | * | 7/1990 | Hartleif | 52/506.08 |

(Continued)

OTHER PUBLICATIONS

Photograph of a ceiling system marketed prior to applicants' priority date.

(Continued)

*Primary Examiner*—Jeanette E. Chapman
(74) *Attorney, Agent, or Firm*—Madson & Austin

(57) ABSTRACT

A sealable ceiling assembly is provided for use in applications such as clean rooms. The sealable ceiling assembly may include main beams suspended from a support ceiling parallel to each other and cross beams that run perpendicular to the main beams to attach the main beams together. Each cross beam has a bore from which coupling members extend to either side. Each coupling member has a head with a cam surface designed to interlock with a retention slot of the main beam in response to ninety-degree rotation of the coupling member. The coupling members are attached within the bores of the cross beams via set screws that can be rotated after engagement to urge retraction of the coupling members into the bore to tighten engagement of the cross beams with the main beams. Stiffeners may be attached to top nut slots of any of the beams that need reinforcement.

20 Claims, 5 Drawing Sheets

U.S. PATENT DOCUMENTS

| | | | | | |
|---|---|---|---|---|---|
| 5,077,951 | A | * | 1/1992 | Baker | 52/506.07 |
| 5,363,625 | A | * | 11/1994 | Philippi | 52/653.2 |
| 5,572,844 | A | * | 11/1996 | Stackenwalt et al. | 52/506.07 |
| 5,634,312 | A | * | 6/1997 | Tolliver et al. | 52/585.1 |
| 5,687,527 | A | * | 11/1997 | Bikard et al. | 52/506.08 |
| 6,125,606 | A | | 10/2000 | Larsson | |
| 6,158,186 | A | | 12/2000 | Feller | |
| 6,779,315 | B1 | * | 8/2004 | Bongio et al. | 52/506.07 |
| 6,789,977 | B2 | * | 9/2004 | Layfield | 403/294 |

OTHER PUBLICATIONS

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

Photograph of a ceiling system marketed prior to applicants' priority date.

* cited by examiner

SEALABLE CEILING ASSEMBLY

RELATED APPLICATIONS

This application claims the benefit of U.S. Provisional Application No. 60/372,950 filed Apr. 16, 2002 and entitled CAM-LOCK GASKET CEILING SYSTEM, and U.S. Provisional Application No. 60/378,336 filed May 7, 2002 and entitled CAM-LOCK CEILING WITH SEALANT TROUGHS, both of which are incorporated herein by reference.

BACKGROUND OF THE INVENTION

1. Field of the Invention

The present invention relates to clean room systems for manufacturing or research. More specifically, the present invention relates to modular, rapidly installable sealable ceiling assemblies and related methods.

2. Description of Related Art

Clean room environments are necessary in a number of fields such as semiconductor manufacturing and biological research. Clean rooms enable processes to be carried out without unacceptable levels of contamination from particulate material. Often, a clean room will be constructed inside of a normal room by adding a filtered barrier to isolate a portion of the room from contaminants. For example, a clean room ceiling may be installed in the room in such a manner that the clean room (i.e., the area underneath the clean room ceiling) is sealed from the room's ventilation system. The clean room ceiling may have filters that receive and cleanse air prior to passage into the clean room.

The clean room ceiling may be assembled by installing a grid, and then positioning air filter diffusion plates, light fixtures, blank panels, or other structures in the spaces of the grid. Unfortunately, known ceiling assemblies and installation methods have a number of inherent deficiencies.

For example, known grids typically require considerable installation time. Some grid sections must be attached to specialized intersection pieces through the use of threaded fasteners such as bolts and the like. This process is quite time consuming because each piece must be manually aligned with the intersection, and then the fasteners must be applied. Other grid sections must be welded together or attached through the use of comparatively complex methods.

Furthermore, many known grids cannot be installed without generating significant amounts of particulate matter. If welding, drilling, or other similar operations are carried out, particulates may be generated and released within the cleanroom environment. This can be problematic, particularly when the ceiling of an operating clean room is to be modified. Operation of the clean room may be interrupted to regain the required air quality, thereby disrupting production and adding to the cost of the modification.

Additionally, many known ceiling systems are quite difficult to modify. Many are installed in a progressive manner, so that one part cannot be altered without changing many adjoining parts. Thus, even small modifications can be quite difficult and disruptive.

Furthermore, some clean room ceiling systems lack the structural rigidity to support maintenance personnel, who may need to walk on the ceiling, or to support components hanging from the ceiling within the clean room envelope. For example, many semiconductor processes utilize an automated materials handling system (AMHS), which will typically be suspended from the ceiling. The AMHS may, itself, be quite heavy, and may convey parts that are highly shock sensitive. Some known ceiling systems deflect excessively under loading such as that of the AMHS, and therefore are not conveniently usable with AMHS hardware. Some known ceiling assemblies are excessively bulky and/or expensive due to the need to support the AMHS.

Accordingly, it would be an advancement in the art to provide a sealable ceiling assembly that is easily and rapidly installable with a minimum of contaminant production. It would also be an advancement in the art to provide a sealable ceiling assembly that is easily and rapidly reconfigurable, and is preferably configured in a non-progressive manner to minimize the intrusiveness of any necessary modifications. Furthermore, it would be an advancement in the art to provide a ceiling assembly that has the structural rigidity to effectively support components such as an AMHS, without excessive bulk or expense.

SUMMARY OF THE INVENTION

The apparatus of the present invention has been developed in response to the present state of the art, and in particular, in response to the problems and needs in the art that have not yet been fully solved by currently available clean room ceilings and related methods. Thus, it is an overall objective of the present invention to provide sealable ceiling assemblies and related methods that remedy the shortcomings of the prior art.

To achieve the foregoing objective, and in accordance with the invention as embodied and broadly described herein in one embodiment, a sealable ceiling assembly is provided. The sealable ceiling assembly has at least one main beam perpendicularly coupled to a plurality of cross beam assemblies. The main beam is suspended from a support ceiling via hanger rod assemblies, which may be positioned at intersections of the main beam with the cross beam assemblies. A plurality of structures such as filter units, light fixtures, flush blank panels, and recessed blank panels, are disposed in spaces defined by the main beam and the cross beam assemblies. The structures are substantially sealed to the main beam and the cross beam assemblies so that air is only able to enter the clean room envelope through the filter units. One or more stiffeners are attached to the beams to enhance bending resistance of the beams.

The main beam has a top nut slot with inwardly extending lips designed to facilitate retention of the hanger rod assemblies. Furthermore, the main beam has a bottom nut slot with inwardly extending lips that facilitate hanging of various structural items, such as lighting, sprinklers, or production equipment such as an automated materials handling system (AMHS). The main beam has shelves on either side on which the aforementioned structures may rest. The main beam also has lateral grooves on either side to facilitate attachment of the aforementioned structures or the like.

The main beam has a first side and a second side substantially symmetrical to the first side. The first side has a first receiving feature, which may take the form of a retention slot with inwardly extending lips that facilitate retention of a cross beam assembly. The second side has a second receiving feature, which may also be a retention slot with inwardly extending lips. Additionally, the first and second sides of the main beam each have a grip feature such as a bead running along their length, alongside the first and second receiving features.

Each cross beam assembly has a cross beam with a first end and a second end, and a coupling member and a spacer disposed at each end. Like the main beam, each cross beam has a top nut slot, a bottom nut slot, shelves on either side, and lateral grooves on either side. These features are similar in form and function to those of the main beam. However, in place of the first and second receiving features, the cross beam has a bore shaped to receive the coupling members. The bore has a plateau along the length of the cross beam and a side wall disposed opposite the plateau.

Each coupling member has an engagement feature designed to be inserted into and retained by one of the receiving features of the main beam. Each engagement feature may comprise a head shaped to be retained by the corresponding retention slot. Each coupling member also has a tightening feature that may take the form of a set screw with a generally conical end. The set screw is accessible through an aperture formed in the side wall of the bore.

Each of the spacers is disposed adjacent to a corresponding coupling member. Each spacer has a shank inserted into one end the top nut slot of the cross beam. Each spacer also has a head extending from the top nut slot, alongside the coupling member. Each hanger rod assembly includes a hanger rod, which is attached to an attachment block via one or more threaded nuts. The attachment block is bolted to the top nut slot of the main beam via T-nuts or the like.

The filter unit, light fixture, flush blank panel, and recessed blank panel may be disposed to rest generally on the shelves of the beams. Gaskets may be disposed adjacent to the shelves to provide a generally airtight seal between the shelves and the structures resting on the shelves.

The stiffener has an attachment portion attached to the top nut slot of one of the beams, which may be a main beam or a cross beam. First and second support webs extend upward from the attachment portion. The first and second support webs are joined to a top nut slot with inwardly extending lips like those of the top nut slots of the beams. Hanger rods may optionally be attached to the top nut slot of the stiffener.

The sealable ceiling assembly is relatively easy to assemble. According to one method, the cross beam assemblies are factory assembled. The first and second coupling members of each cross beam assembly may first be assembled. Each coupling member has a body with which the head is integrally formed. The body has a neck with a comparatively small cross sectional area that couples the head with the remainder of the body. The head has a cam surface shaped such that the head can pass between the inwardly extending lips of the corresponding receiving feature in a disengaged orientation, but not in an engaged orientation.

The body also has a threaded hole sized to receive the set screw and a groove. The groove has a generally cylindrical shape designed to receive a resilient member, which may have the form of a rubber cord or the like. The set screw is rotated into engagement with the threaded hole and the resilient member is inserted into the groove.

Once assembled, the coupling members are inserted into the bore of the cross beam at the first and second ends. Each set screw moves into general alignment with a generally conical countersink formed in the plateau within the bore. The set screws are actuated a small distance into the generally conical countersinks so that the coupling members cannot be withdrawn from the bore without loosening the set screws. The resilient members press against the cross beam to urge the coupling members to protrude as far as possible from the bore, thereby facilitating installation The spacers are installed in the top nut slot via press fitting or the like or a similar method. The shanks of the spacers are thus retained within the top nut slot while the heads of the spacers extend outward, alongside the heads of the coupling members. The head of each spacer has a groove designed to engage the corresponding bead of the main beam.

After the coupling members and spacers have been installed in a cross beam, the resulting cross beam assembly may be attached to a pair of parallel main beams. The main beams may be attached to a support ceiling or some other supporting structure via the hanger rods or the like. The cross beam assembly may be rotated to an orientation ninety degrees from the orientation of the main beams, so that both cam surfaces are disposed in the disengaged orientation. Then, the cross beam may be inserted between the main beams so that the heads enter the retention slots of the main beams.

When the heads are within the retention slots, the cross beam is rotated ninety degrees about its lengthwise axis to bring the cross beam upright and rotate the heads into the engaged position. The heads are then positioned such that the inwardly extending lips of the receiving features interfere with removal of the heads from the receiving features.

Throughout the insertion and rotation process, the coupling members are able to slide with limited displacement within the first and second ends of the cross beam. After the cross beam has been rotated upright, the cross beam may be tightened against the main beams. This is performed by tightening the set screws of the coupling members to urge the generally conical ends further into the generally conical countersinks. The coupling members are withdrawn further into the bore, against the urging of the resilient members, as the generally conical ends become more nearly coaxial with the generally conical countersinks. Thus, the first and second ends of the cross beam are urged against the corresponding sides of the main beams.

As the first and second ends of the cross beam are drawn against the sides of the main beams, the spacers press against the sides of the main beams in such a manner that the beads are captured by the grooves of the spacers. As a result, rotation of the cross beam is not possible without loosening the set screws. Thus, the coupling members remain in the engaged orientation until the cross beam assembly is deliberately loosened and rotated. The filter units, light fixtures, blank pans, or other structures may then be installed through the aid of the gaskets.

The stiffener is also relatively easy to install. The stiffener may be attached to any cross beam, main beam, or main beam segment that will be subject to undue bending stress. For example, a stiffener may be attached to any beam from which a comparatively heavy load, such as an AMHS, is suspended. The stiffener may be attached to the beam after the remainder of the sealable ceiling assembly 10 has been constructed.

The attachment portion of the stiffener has lateral extensions that extend along the width of the top nut slot to provide a stable fit between the attachment portion and the beam. The attachment portion also has a trough with a plurality of holes, each of which permits passage of a threaded end of a bolt into the top nut slot. The bolts are anchored in T-nuts or other devices disposed and retained within the top nut slot of the beam. Each bolt has a head seated in the top nut slot of the stiffener such that the bolts can be tightened to press the attachment portion against the beam.

The support webs extend vertically from the beam, thereby providing a relatively high section modulus for the beam/stiffener combination. Consequently, the stiffener lends considerable bending support to the beam, and is easily installed without requiring disassembly of any part of the sealable ceiling assembly.

Through the use of the sealable ceiling assembly and related methods presented herein, a sealed ceiling may be rapidly installed or modified with a minimum of contaminant production. Furthermore, reinforcement may be easily and cost-effectively added to facilitate use with hanging clean room equipment such as an AMHS. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 5, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "attached directly to" refers to a form of attachment by which the attached items are either in direct contact, or are only separated by a single fastener, adhesive, or other attachment mechanism. The term "abutting" refers to items that are in direct physical contact with each other, although the items may not be attached together. The terms "integrally formed" refer to a body that is manufactured unitarily, i.e., as a single piece, without requiring the assembly of multiple pieces. Multiple parts may be integrally formed with each other if they are formed from a single workpiece.

Figure 1:
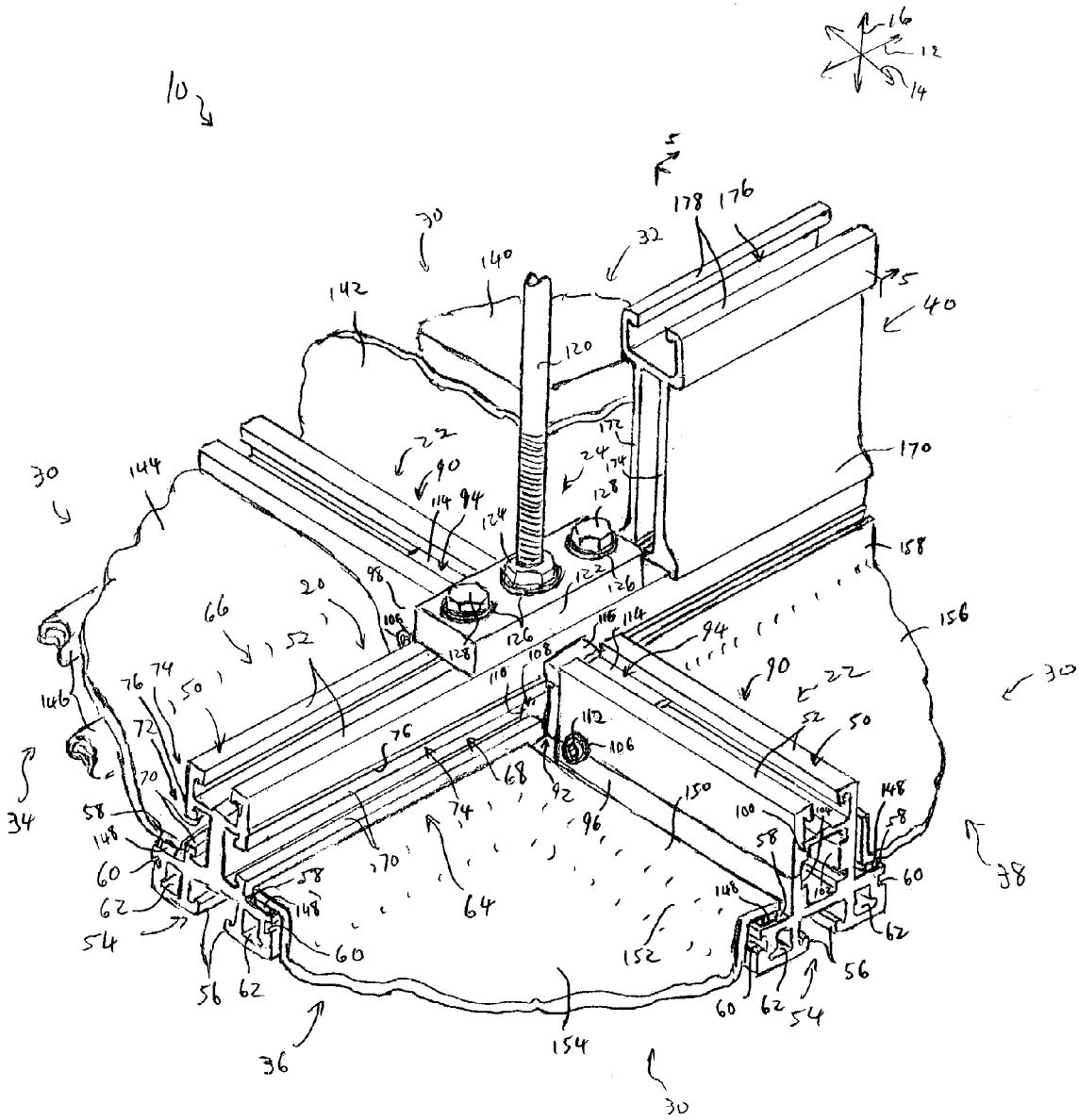
FIG. 1 is a perspective view of a portion of a sealable ceiling assembly including a coupling member and a stiffener according to one embodiment of the invention, in a fully assembled state.

Referring to FIG. 1, a perspective view illustrates a portion of a sealable ceiling assembly 10, or assembly 10, according to one embodiment of the invention. The assembly 10 may be used for a clean room ceiling or some other sealed barrier. The assembly 10 has a longitudinal direction 12, a lateral direction 14, and a transverse direction 16. The assembly 10 has a first main beam 20, which extends generally in the longitudinal direction 12. Furthermore, the assembly 10 has a plurality of cross beam assemblies 22 attached to the first main beam 20 and extending perpendicular to the first main beam 20.

The first main beam 20, and thence the cross beam assemblies 22, may be supported from a higher support ceiling or the like via hanger rod assemblies 24, only one of which is illustrated in FIG. 1. If desired, the hanger rod assemblies 24 may be disposed at intersections between the first main beam 20 and the cross beam assemblies 22, as illustrated. The first main beam 20 may be formed of extruded aluminum or some other material with a comparatively high strength.

The assembly 10 includes a plurality of structures 30 disposed in the spaces defined by the first main beam 20 and the cross beam assemblies 22. More precisely, the structures 30 may include a filter unit 32, a light fixture 34, a flush blank panel 36, and a recessed blank panel 38. The filter unit 32, the light fixture 34, the flush blank panel 36, and the recessed blank panel 38 are all shown simply by way of example; a wide variety of ceiling structures may be installed in the spaces defined by the first main beam 20 and the cross beam assemblies 22.

A stiffener 40 is also attached to the first main beam 20. The stiffener 40 provides bending support for the segment of the first main beam 20 to which it is attached. More precisely, if a load such as an automated materials handling system (AMHS) is disposed to hang from the first main beam 20, within the clean room envelope, the stiffener 40 may be used to add flexural rigidity to the first main beam 20, thereby preventing excessive deflection.

As illustrated, the first main beam 20 has a number of features that facilitate assembly, attachment, and sealing. For example, the first main beam 20 may have a top nut slot 50, which may be termed an "integral nut slot." The top nut slot 50 extends for the length of the first main beam 20 and has inwardly extending lips 52 that facilitate retention of T-nuts or other fastening elements within the top nut slot 50. The hanger rod assemblies 24 are coupled to the top nut slot 50 to support the first main beam 20. The first main beam 20 also has a bottom nut slot 54, which is also an "integral nut slot," to which items can be attached in a similar manner to enable suspension of the items from the first main beam 20. The bottom nut slot 54 has inwardly extending lips 56 similar to the inwardly extending lips 52 of the top nut slot 50.

The first main beam 20 also has shelves 58 on either side. The structures 30 may be disposed to rest on the shelves 58. Additionally, the first main beam 20 has lateral grooves 60 disposed just beneath the shelves 58. The lateral grooves 60 may also be used for attachment of the structures 30 to the first main beam 20 or for suspension of items from the first main beam 20. The first main beam also has cavities 62 beneath the shelves to reduce the weight and material cost of the first main beam 62.

The first main beam 20 has a first side 64 and a second side 66, which is substantially symmetrical to the first side 64. As shown, the first side 64 has a receiving feature, which may take a variety of forms including but not limited to slots, sockets, hooks, locking flanges, and the like. In the embodiment of FIG. 1, the receiving feature is a first retention slot 68. The first retention slot 68 has inwardly extending lips 70 that facilitate retention of a fastener or other article within the first retention slot 68. Similarly, the second side 66 has a receiving feature, which may be a second retention slot 72 with inwardly extending lips 70 similar to those of the first retention slot 68.

Grip features 74 are also disposed on each of the first and second sides 64, 66. The grip features 74 facilitate retention of the cross beam assemblies 22 against the first main beam 20. The grip features 74 may, in alternative embodiments, include frictional pads, a variety of interlocking pieces, and the like. In the embodiment of FIG. 1, each of the grip features 74 includes a bead 76 formed in the surface of the first or second sides 64, 66 and extending along the length of the first main beam 20.

Each of the cross beam assemblies 22 includes a cross beam 90. The cross beams 90, like the first main beam 20, may be formed of a comparatively strong material such as extruded aluminum. Additionally, each cross beam assembly 22 includes a first coupling member 92 and a second coupling member (not visible in FIG. 1), as well as a pair of spacers 94, each of which is disposed adjacent to one of the coupling members. More precisely, each cross beam 90 has a first end 96 facing the first side 64 of a main beam and a second end 98 facing the second side 66 of another main beam. The first coupling member 92 and one spacer 94 are coupled to the first end 96 of the cross beam 90, while the second coupling member and the other spacer 94 are coupled to the second end 98.

Each of the cross beams 90 has a top nut slot 50 with inwardly extending lips 52, a bottom nut slot 54 with inwardly extending lips 56, a pair of symmetrical shelves 58, a pair of symmetrical lateral grooves 60, and cavities 62, all of which are similar in function and configuration to those of the first main beam 20. However, in place of the first and second retention slots 68, 72, each cross beam 90 has a bore 100 extending through and along the length of the cross beam 90. Each cross beam 90 has a plateau 102 extending into the bore 100 and a side wall 104 opposite the plateau 102. The side wall 104 of each cross beam 90 has a pair of apertures 106 formed therein, at each of the first and second ends 96, 98.

The first coupling member 92 includes an engagement feature 108, which is only partially visible in FIG. 1. The engagement feature 108 engages the first retention slot 68 of the first side 64 of the first main beam 20 to attach the associated cross beam assembly 22 to the first main beam 20. In this application, "engagement" refers to two parts that contact each other in a manner that restricts at least one type of relative motion of the parts.

The engagement feature 108 may be embodied in a wide variety of ways including cams, clips fasteners, hooks, and the like. In the embodiment of FIG. 1, the engagement feature 108 comprises a head 110 that can be rotated between a disengaged position in which the head 110 is not retained by the first retention slot 68, and an engaged position in which the head 110 is retained by the first retention slot 68. The shape of the head 110 and the manner in which the head 110 operates to expedite assembly of the assembly 10 will be shown and described in greater detail subsequently.

The first coupling member 92 also includes a tightening feature that can be actuated to tighten engagement of the associated cross beam assembly 22 with the first main beam 20. A "tightening feature" includes a variety of structures, including but not limited to set screws, locking nuts, ratchet systems, worm gear systems, and the like.

In the embodiment of FIG. 1, the tightening feature takes the form of a set screw 112 having a hexagonal interface designed to receive an Allen wrench or the like. The set screw 112 interacts with the first end 96 in such a manner that rotation of the set screw 112 induces retraction of the first coupling member within the bore 100 of the cross beam 90, thereby pressing the first end 96 against the first side 64 of the first main beam 90. The manner in which the set screw 112 interacts with the first end 96 will be described in greater detail subsequently.

Each of the spacers 94 has a shank 114 and a head 116. The shank 114 is seated in the top nut slot 50 of the cross beam 90 in such a manner that the head 116 lies generally alongside or proximate the head 110 of the coupling member 92. When the attachment of the cross beam assembly 22 to the first main beam 20 is tightened via the set screw 112, the head 116 of the spacer 94 abuts the first side 96 to prevent relative rotation between the cross beam assembly 22 and the first main beam 20, in a manner that will be shown and described hereafter.

The first main beam 20 is supported by the hanger rod assembly 24, as shown. Other hanger rod assemblies (not shown) may also be present, and may be attached to any combination of the first main beam 20, other main beams, the cross beams 90, and the stiffener 40, including any other stiffeners present.

In the configuration of FIG. 1, the hanger rod assembly 24 includes a hanger rod 120 and an attachment block 122 to which the hanger rod 120 is attached via a nut 124. A washer 126 may also be used to facilitate the attachment. The attachment block 122, in turn, may be attached to the top nut slot 50 via bolts 128 and additional washers 126. The bolts 128 may be attached to T-nuts (not shown) or other fastening devices designed to be retained within the top nut slot 50. The upper end (not shown) of the hanger rod 120 is attached to a support ceiling (not shown) or other stable overhead structure.

As mentioned previously, the structures 30 are disposed in the spaces defined by attachment of the cross beam assemblies 22 to the first main beam 20. The filter unit 32 is designed to circulate cleansed air into the clean room envelope. Several filter units 32 may be distributed in a relatively regular pattern over the area covered by the assembly.

The filter unit 32 may have an air filter 140 such as a HEPA filter or the like, and a housing 142 that directs the air through the air filter 140. Portions of the housing 142 and the air filter 140 have been cut away in FIG. 1 to avoid obscuring other aspects of the invention. The filter unit 32 may also include a diffusion panel or the like (not visible in FIG. 1) that distributes the filtered air within the clean room envelope. If desired, the filter unit 32 may have additional components such as a fan (not shown) disposed above the filter 140.

The light fixture 34 provides artificial lighting. Several lighting fixtures 34 may be distributed in a relatively even pattern over an area covered by the assembly. Alternatively, artificial lighting may be provided in a different way, such as through the use of teardrop lighting suspended from the bottom nut slots 54 of the first main beam 20 and/or the cross beams 90. As shown, the light fixture 34 has a backing plate 144, which may have a recessed shape with respect to the clean room envelope. The light fixture 34 also has fluorescent lights 146, as illustrated.

The backing plate 144 is disposed to rest on a gasket 148 on the shelves 58 of the first main beam 20 and the cross beams 90. The gasket 148 has a generally rectangular shape that corresponds to the shape of the shelves 58. The gasket 148 may be constructed of an elastomer such as silicon rubber or some other material that forms a reliable seal between the backing plate 144 and the shelves 58. A similar gasket 148 (not visible in FIG. 1) may be used to form a seal between the housing 142 of the filter unit 32 and the corresponding shelves 58.

The flush blank panel 36 serves as an aesthetic covering and maintains the seal provided by the assembly. The flush blank panel 36 may be formed of a wide variety of materials such as metals, polymers, and the like. The flush blank panel 36 has a ledge 150 that rests on a gasket 148 like that of the light fixture 34. The gasket, in turn, rests on the corresponding shelves 58 of the first main beam 20 and the cross beams 90. A generally vertical wall section 152 extends downward from the ledge 150 to reach a flat surface 154 positioned generally flush with the bottom surfaces of the first main beam 20 and the cross beams 90. The flush positioning may be advantageous for aesthetic reasons and to provide an enhanced seal when positioned directly over a wall of the clean room environment.

The recessed blank panel 38 may be used as an alternative to the flush blank panel Both panels 36, 38 are illustrated as existing within the assembly 10 for purposes of illustration; in actual practice, a customer may wish to choose between the use of recessed blank panels 38 or that of flush blank panels 36. The recessed blank panels 38 operate in a manner similar to that of the flush blank panels 36. However, the recessed blank panels 38 have a flat surface 156 that rests directly on a gasket 148 disposed on the corresponding shelves 58 of the first main beam 20 and the cross beams 90. A generally vertical wall section 158 extends upward from the edges of the flat surface 156 to facilitate handling of the recessed blank panel 38.

The structures 30, as described above, have been illustrated and described in simplified form because details thereof would be apprehended by those of skill in the art without the need for more specific disclosure. Those of skill in the art would also recognize that the structures 30 may be replaced with a wide variety of other implements, or supplemented with additional hardware such as safety sprinkler systems and the like.

Like the first main beam 20 and the cross beams 90, the stiffener 40 may be formed of a comparatively strong material such as extruded aluminum. As illustrated, the stiffener 40 has an attachment portion 170 coupled to the top nut slot 50 of the first main beam 50. The stiffener 40 has a first support web 172 and a second support web 174 that extend upward from the attachment portion 170 to a top nut slot 176. The first and second support webs 172, 174 add flexural rigidity to the stiffener 40, and thence, to the portion of the first main beam 20 to which the stiffener 40 is attached.

The top nut slot 176 of the stiffener 40 has inwardly extending lips 178 similar to the inwardly extending lips 52 of the top nut slot 50 of the first main beam 20 and the cross beams 90. The top nut slot 176 permits attachment of implements such as the hanger rod assembly 24 to the stiffener 40 to provide additional structural support.

Figure 2:
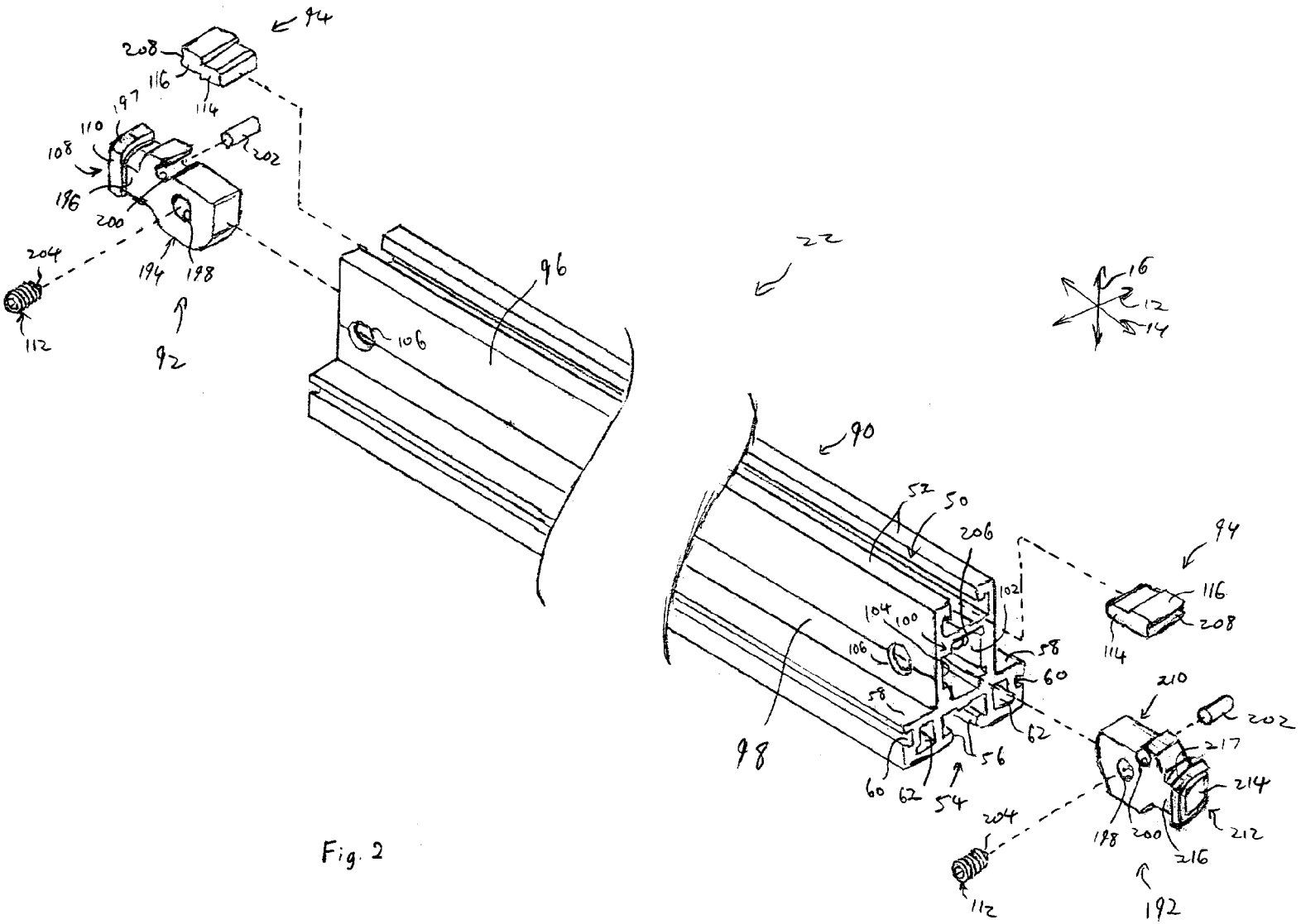
FIG. 2 is an exploded, perspective view of the cross beam assembly of the sealable ceiling assembly of claim 1.

The sealable ceiling assembly 10 of FIG. 1 may be assembled in a comparatively rapid and tidy manner. The cross beam assemblies 22 may be easily assembled, attached to the first main beam 20, and tightened against the first main beam 20 in a manner that will be set forth below. FIG. 2 illustrates one manner in which the cross beam assemblies 22 may be assembled.

Referring to FIG. 2, an exploded, perspective view illustrates one of the cross beam assemblies 22 of FIG. 1. Thus, FIG. 2 shows the cross beam 90, the first coupling member 92, the spacers 94, and a second coupling member 192, with dashed lines to indicate how the coupling members 92, 192 will be assembled and how the coupling members 92, 192 and the spacers 94 are to be inserted into the cross beam 90. If desired, the process of assembling the cross beam assembly 22 may be performed by the manufacturer of the cross beam 90 so that the customer need only attach the cross beam assembly 22 to the first main beam 20.

As shown, the first coupling member 92 has a body 194, which may be formed of steel through the use of a process such as investment casting. The body 194 has a neck 196 that couples the head 110 with the remainder of the body 194. The head 110 has a cam surface 197 that is curved and dimensioned in such a manner that the head 110 can pass between the inwardly extending lips 70 of the first retention slot 68 in a disengaged orientation, but not in an engaged orientation angularly displaced from the disengaged orientation by ninety degrees.

In this application, the term "cam surface" refers to a curved surface with a contour designed to abut a second part, such as a follower, to provide a desired type of relative force or motion between the parts in response to rotation of the cam surface. The shape of the cam surface 197 facilitates rotation of the head 110 within the first retention slot 68. The neck 196 has a similar shape that facilitates rotation of the neck 196 against the inwardly extending lips 70 of the first retention slot 68.

Furthermore, the body 194 has a threaded hole 198 that threadably receives the set screw 112. The threaded hole 198 extends generally along the longitudinal direction 12; hence, the set screw 112 is movable in the longitudinal direction. The body 194 also has a groove 200, which may have a generally cylindrical shape sized to retain a resilient member 202 having a generally cylindrical shape. The resilient member 202 may be a length of rubber cord or the like. The resilient member 202 may simply be pressed into the groove 200.

Once the set screw 112 and the resilient member 202 have been installed in the body 194, as shown, the first coupling member 92 is ready to be installed in the first end 96 of the cross beam 90. The set screw 112 is initially positioned to permit relatively free motion of the first coupling member 92 with respect to the first end 96. The set screw 112 has a generally conical end 204.

The first coupling member 92 moved longitudinally into the bore 100, in the first end 96, until the set screw 112 is generally aligned with a generally conical countersink 206 in the first end 96 (not visible in FIG. 2). A similar generally conical countersink 206 is disposed in the second end 98. When the set screw 112 is aligned with the generally conical countersink 206, the set screw 112 is actuated slightly so that the tip of the generally conical end 204 is disposed within the generally conical countersink 206. Thus, the first coupling member 92 is unable to be removed from the first end 96 without deliberately loosening the set screw 112.

As the first coupling member 92 moves into the first end 96, the edges of the resilient member 202 are deflected by contact with the edges of the first end 96. The resilient member 202 thus presses outward against the first coupling member 92 to urge withdrawal of the first coupling member 92 from the first end 96. However, once the set screw 112 has been actuated to dispose the generally conical end 204 within the generally conical countersink 206, the first coupling member 92 is not removable from the first end 96 without actuating the set screw 112. Thus, the first coupling member 92 will stay in the first end 96 during installation and will be resiliently extended to facilitate engagement of the head 110 with the first retention slot 68.

As shown, the shank 114 of each spacer 94 is shaped such that the spacers 94 can be press fit into the ends of the top nut slot 50. The head 116 of each spacer 94 is shaped to form a groove 208 that extends in the longitudinal direction 12 to securely engage the corresponding bead 76 of the first main beam 20.

The second coupling member 192 is configured in a manner similar to that of the first coupling member 92. More precisely the second coupling member 192 may also be formed of investment cast steel or some other comparatively strong and rigid material. The second coupling member 192 has a body 210 with a shape similar to that of the body 192 of the first coupling member 92. The body 210 has a second engagement feature 212 similar to the engagement feature 110 of the first coupling member 92.

More precisely, the second engagement feature 212 comprises a head 214 coupled to the remainder of the body 210 by a neck 216. The head 214 has a cam surface 217 curved and dimensioned in such a manner that the head 214 can pass between the inwardly extending lips 70 of the second retention slot 72 of a second main beam (not shown) in a disengaged orientation, but not in an engaged orientation angularly displaced from the disengaged orientation by ninety degrees.

The cam surface 217 is oriented such that both heads 110, 214 can be rotated "in tandem," i.e., in the same direction to simultaneously move the heads 110, 214 from the disengaged orientation to the engaged orientation. Thus, the heads 110, 214 are not shaped identically, but rather, symmetrically so that the heads 110, 214 can rotate in the same direction even though they face opposite directions. The neck 216 is shaped to facilitate rotation of the neck 216 against the inwardly extending lips 70 of the second retention slot 72.

The body 210 also has a threaded hole 198 for receiving the corresponding set screw 112 and a groove 200 for receiving the corresponding resilient member 202. The set screw 112 and the resilient member 202 are installed in the second coupling member 192 and the second coupling member 192 is installed in the second end 98 of the cross beam 90 in a manner similar to that of installation of the first coupling member 92 in the first end 96. The set screw 112 is actuated to move the generally conical end 204 thereof into the generally conical countersink 206 of the second end 98. The corresponding spacer 94 is installed in a manner similar to that of the spacer 94 proximate the first coupling member 92.

The cross beam assembly 22 is then ready for attachment to the first main beam 20 and/or other main beams. One manner in which such attachment may be performed will be shown and described in connection with FIG. 3, as follows.

Figure 3:
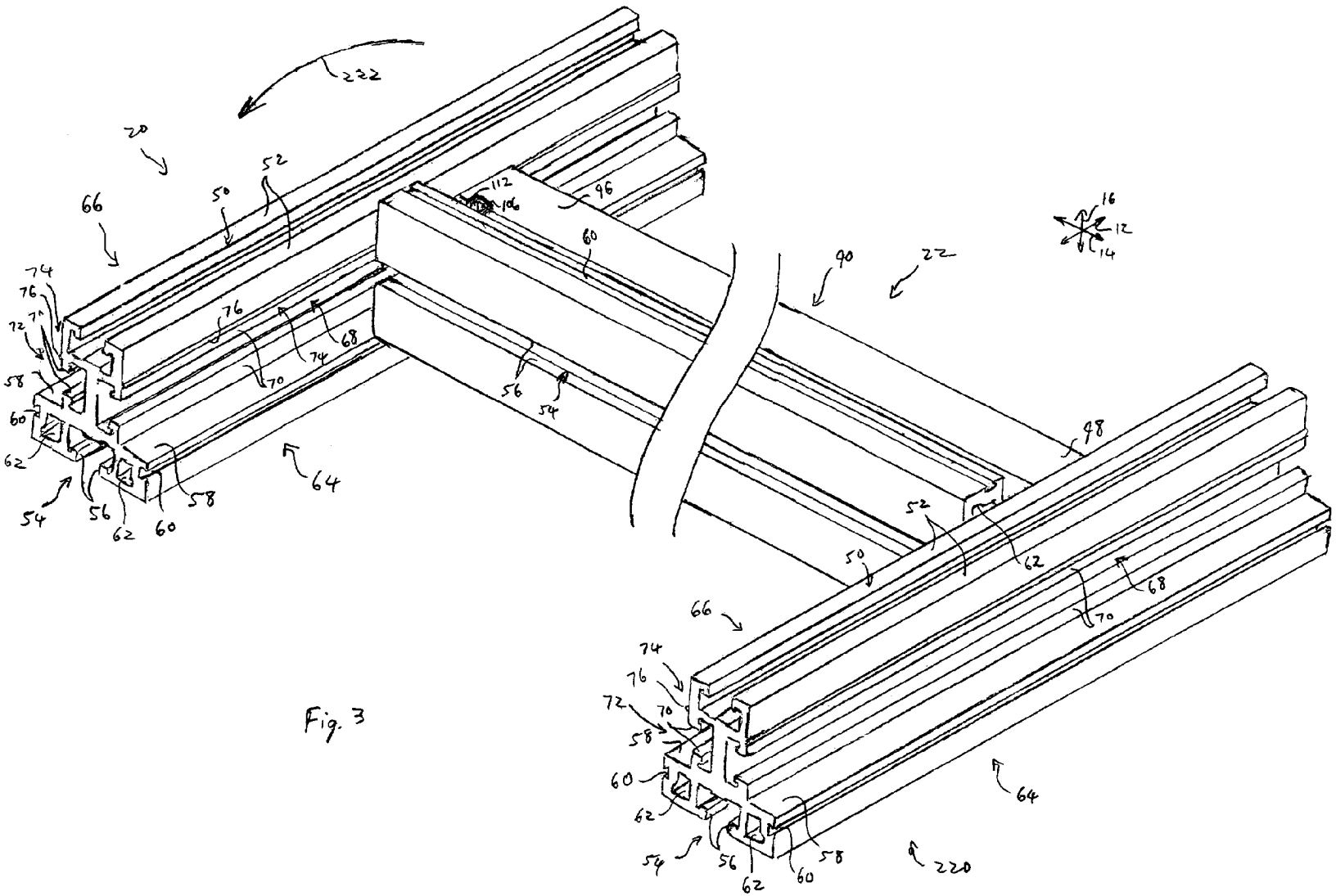
FIG. 3 is a perspective view of the cross beam of the sealable ceiling assembly of FIG. 1, positioned for attachment to two main beams, but not yet oriented to engage the main beams.

Referring to FIG. 3, a perspective view illustrates one manner in which the cross beam assembly 22 may be assembled to the first main beam 20 and to a second main beam 220 parallel to the first main beam 20. The second main beam 220 may be virtually identical to the first main beam 20. The first and second main beams 20, 220 may initially be suspended from a support ceiling (not shown) via a plurality of hanger rod assemblies 24. The first and second main beams 20, 220 are not then coupled together, but are displaced from each other by a displacement commensurate with the length of the cross beam 90. In certain embodiments, this length may be about four feet.

Attachment of the cross beam assembly 22 to the main beams 20, 220 may begin with orientation of the cross beam assembly 22 in the disengaged orientation. The heads 110, 214 of the first and second coupling members 92, 192 are then in an orientation that permits the heads 110, 214 to be moved in the lateral direction 14 to insert the heads 110, 214 into the first and second retention slots 68, 72, respectively. Thus, the main beams 20, 220, which swing relatively freely toward or away from each other until attached together, may be moved apart and the cross beam assembly 22 may be disposed between them with the heads 110, 214 in alignment with the retention slots 68, 72. The first and second main beams 20, 220 may then be drawn together again so that the heads 110, 214 enter the retention slots 68, 72 of the first and second main beams 20, 220, respectively.

Alternatively, if the main beams 20, 220 are unable to move apart, the cross beam assembly 22 may be disposed in the disengaged orientation and disposed at an angle within the plane in which the main beams 20, 220 reside (i.e., the plane defined by the longitudinal and lateral directions 12, 14). The cross beam assembly 22 may then be rotated into alignment with the lateral direction 14 so that the heads 110, 214 enter the retention slots 68 along directions nearly parallel to the longitudinal direction 12. This method may be especially useful for replacing a cross beam assembly 22 or otherwise modifying a sealable ceiling assembly 10 in which the main beams 20, 220 are already connected together. The main beams 20, 220 need not be decoupled from all cross beam assemblies 22 to remove or modify a single cross beam assembly 22.

The heads 110, 214 are then disposed within the retention slots 68, 72, and are still in the disengaged orientation. Thus, the heads 110, 214 are relatively freely removable from the retention slots 68, 72. The cross beam assembly 22 is rotated upright, i.e., in the direction indicated by the arrow 222, to rotate both of the heads 110, 214 to the engaged orientation, thereby locking the cross beam assembly 22 in place between the main beams 20, 220. Over-rotation is prevented by the shape of the cam surfaces 197, 217. Since the cross beam 90 lies on its side prior to rotation, as illustrated in FIG. 3, rotation of the cross beam assembly 22 through a ninety-degree angular displacement is needed to bring the cross beam 90 upright.

Figure 4:
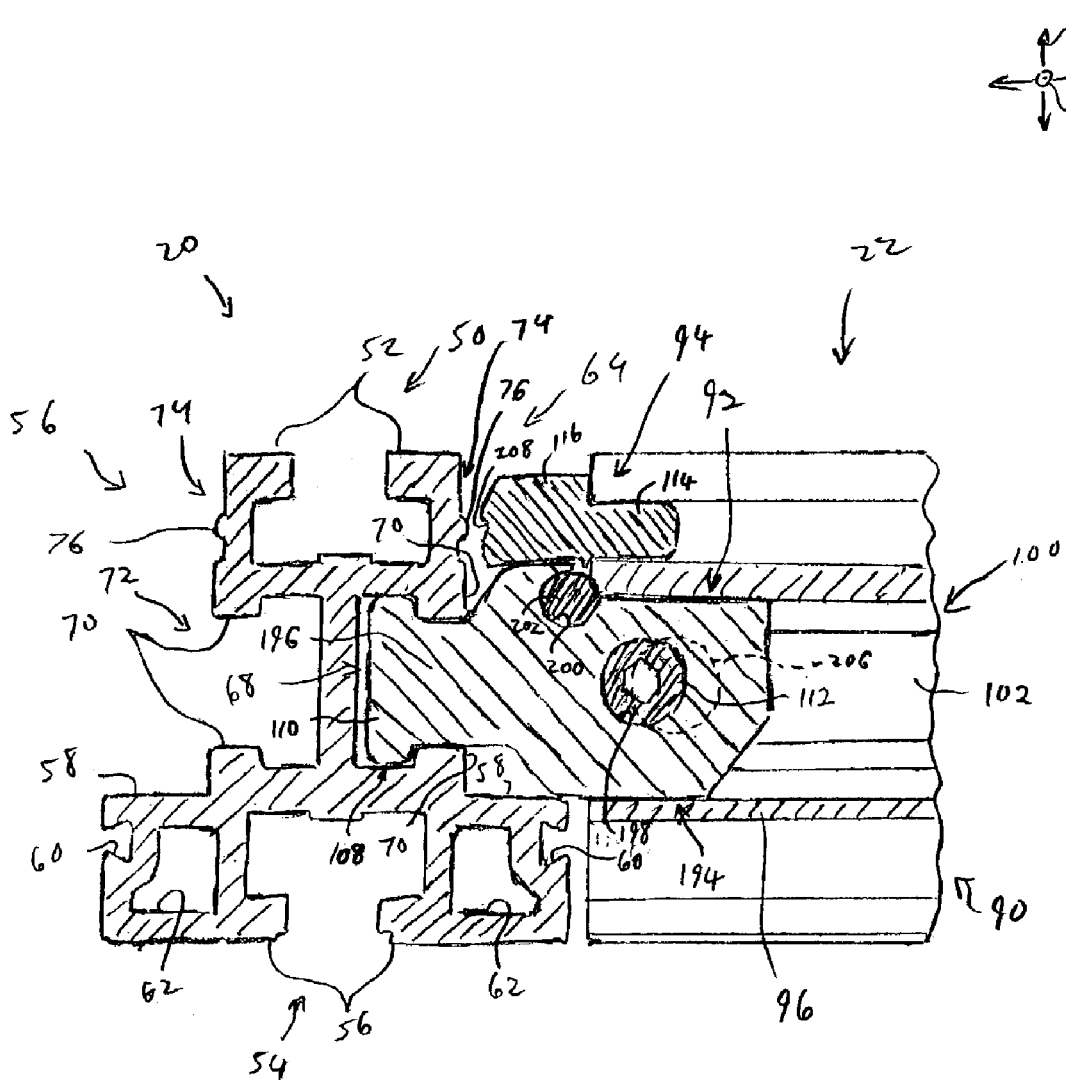
FIG. 4 is a side elevation, section view one side of the cross beam assembly of the sealable ceiling assembly of FIG. 1, with the coupling member engaging the main beam, but not yet tightened against it.

Referring to FIG. 4, a side elevation, section view illustrates the configuration of the junction between the first main beam 20 and the cross beam assembly 22 after rotation of the cross beam assembly 22 to the engaged position. As shown by the section view, the head 110 then occupies the transverse dimension of the first retention slot 68, and therefore cannot be withdrawn in the lateral direction 14 without rotating the cross beam assembly 22 back to the disengaged orientation.

However, a gap still remains between the first end 96 of the cross beam 90 and the first side 64 of the first main beam 20. The set screw 112 may be actuated to tighten the first end 96 against the first side 64. More specifically, the set screw 112 may be tightened, or driven into the generally conical countersink 206 of the first end 96 through the use of an Allen wrench or the like. The generally conical end 204 of the set screw 112 presses against the generally conical countersink 206 to retract the first coupling member 92 into the first end 96 until the generally conical end 204 is substantially coaxial with the generally conical countersink 206.

As the first coupling member 92 is retracted, the first main beam 20 is drawn in the lateral direction 14 until the first side 64 of the first main beam 20 is in contact with the first end 96 if the cross beam 90. The resilient member 202 presses against the upper surface of the bore 100 and is deflected thereby. Furthermore, the bead 76 is drawn into the groove 208 of the spacer 94 in such a manner that the groove 208 captures the bead 76. Thus, the cross beam assembly 22 is unable to rotate back to the position illustrated in FIG. 3 without deliberate actuation of the set screw 112.

The set screw 112 of the second coupling member 192 may be actuated in a similar manner to tighten the second end 98 (not shown in FIG. 4) against the second side 98 of the second main beam 220. Many cross beam assemblies 22 may be positioned, engaged, and then tightened in this manner until a grid is formed for the sealable ceiling assembly 10. When the grid is in place, the structures 30 may be positioned and/or attached in the spaces defined by the grid to complete assembly of an airtight barrier.

However, the barrier need not form a complete hermetic seal. Rather, the clean room envelope may be positively pressurized so that the airflow is continuously directed out of the clean room environment. Hence, in this application, "sealable" refers to an object capable of restricting airflow out of a space at least enough to maintain positive pressure within the airspace when fans or air pumps are applied to direct clean air into the space. However, if desired, gel materials or other sealants may be applied to provide a complete hermetic seal.

According to one alternative embodiment of the invention, rotation need not be applied to coupling members to provided engagement. Rather, the main beams (not shown) may have retention slots like the retention slots 68, 72 with inwardly extending lips like the inwardly extending lips 70. However, the inwardly extending lips may diverge from each other at one or more locations to provide one or more insertion portions, such as keyholes or rectangular openings, through which a head may pass into the retention slot. Coupling members may then have heads with simple circular or even rectangular shapes, without the need for the cam surfaces 197 or 217.

Each coupling member may have a tightening feature like the set screws 112 of the first and second couplings 92, 192 to enable tightening of the cross beams against the main beams in a manner similar to that set forth above. A cross beam assembly may then be installed by, first, inserting the heads through the insertion portions of the retention slots, and sliding the heads away from the insertion portions so that the inwardly extending lips prevent withdrawal of the heads from the retention slots. The cross beam assembly may then be tightened against the main beams with the tightening features to keep the cross beam assemblies in place. Other alternative embodiments would be envisioned by a person of skill in the art with the aid of the present disclosure.

Figure 5:
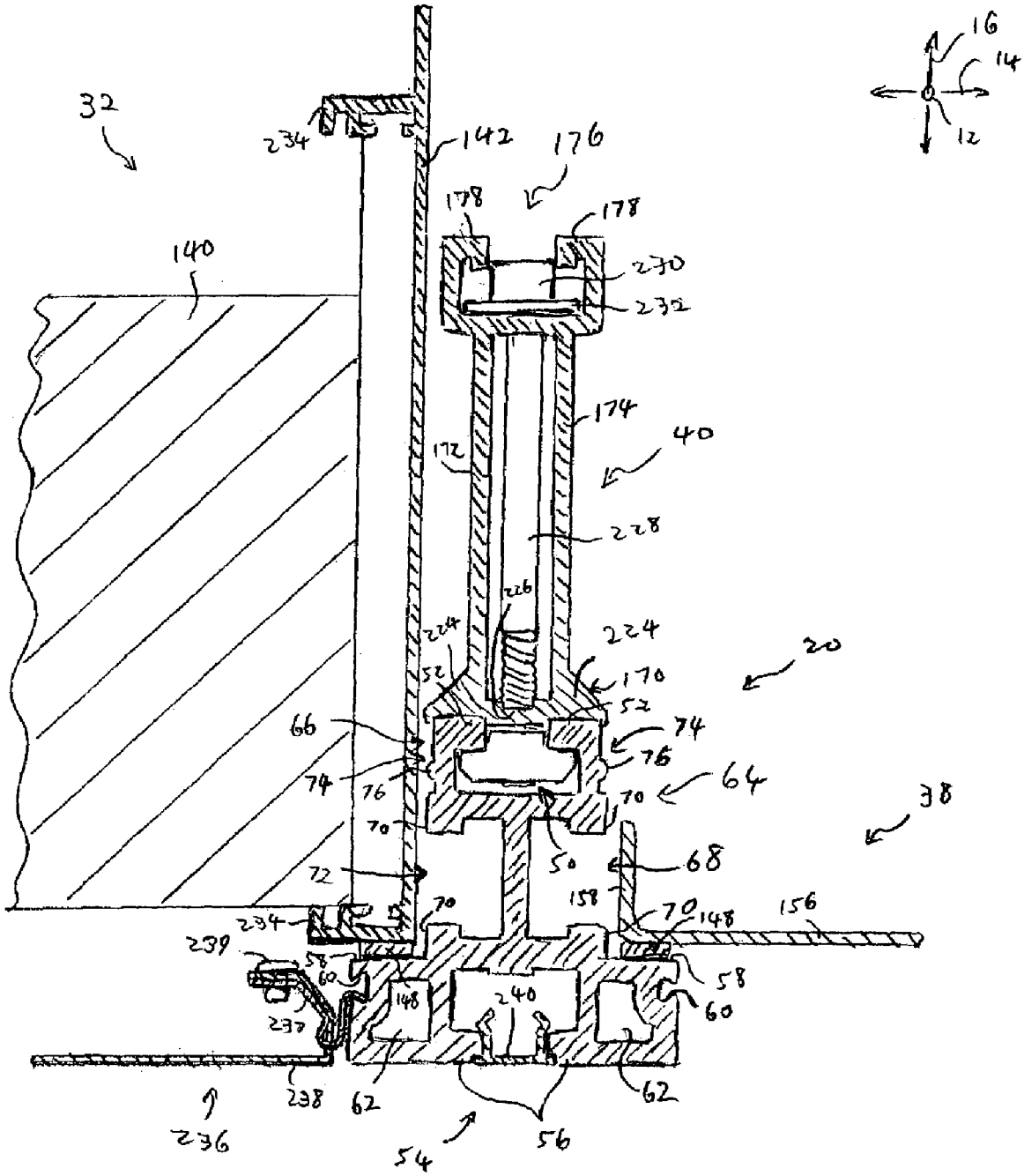
FIG. 5 is side elevation, section view of the main beam, stiffener, and portions of adjacent components of the sealable ceiling assembly, taken along line 5—5 of FIG. 1.

Referring to FIG. 5, a side elevation, section view illustrates the first main beam 20 with the attached stiffener 40. As mentioned previously, the stiffener 40 may be attached to the first main beam 20 to enhance the bending resistance of the first main beam 20. The stiffener 40 may be attached after the remainder of the assembly 10 has been constructed, and may even be applied to a sealable ceiling assembly that has already been in use for some time.

As shown, the attachment portion 170 of the stiffener 40 has lateral extensions 224 extending in the lateral direction 14 to provide stable attachment to the first main beam 20. The attachment portion 170 also has a trough 226 extending in the longitudinal direction. A plurality of openings (not visible) are disposed in the trough 226 to receive a plurality of bolts 228, one of which is visible in FIG. 5. The trough 226 may facilitate insertion of the ends of the bolts 228 through the openings and into the top nut slot 50 of the first main beam 20, wherein the bolts 228 may be anchored through the use of T-nuts or other hardware. Each of the bolts 228 has a head 230 anchored in the top nut slot 176 of the stiffener 40. A washer 232 is sandwiched against the interior of the top nut slot 176 by the head 230.

The bolts 228 keep the stiffener 40 attached firmly to the first main beam 20 along its length to ensure that the flexural rigidity of the stiffener 40 is imparted to the first main beam 20. If desired, the bolts 228 may be tightened with a pre-established torque to ensure that the attachment of the stiffener 40 to the first main beam 20 is sufficiently tight.

The stiffener 40 may advantageously be at least half the length, or further, nearly as long as the beam or segment to which it is attached. For example, if the hanger rod assemblies 24 are placed four feet (forty-eight inches) from each other, the stiffener 40 may be about forty-four inches in length to provide the maximum possible stiffening capability without interfering with placement of the attachment blocks 122 of the hanger rod assemblies 24. The stiffener 40 may alternatively be made somewhat shorter if desired.

The first and second support webs 172, 174 extend from the first main beam 20 with a considerable height in the transverse direction 16. This transverse height may be great enough that the stiffener 40 is taller than the first main beam 20 (or other beam to which it is attached) in the transverse direction. As a result, the stiffener 40 has a high resistance against bending in the transverse direction 16. This transverse bending resistance helps the first main beam 20 to resist bending due to transverse loading, such as the loading that would be placed on the first main beam 20 by a heavy item suspended from the bottom nut slot 54.

Any number of stiffeners 40 may be applied to strengthen the sealable ceiling assembly 10. If desired, structural analysis of the assembly 10 may be performed to find the main beams and cross beams with the highest bending stresses. If any beams have a bending stress level that corresponds to more than a threshold level of deflection, such as one-eighth of an inch, a stiffener 40 may be attached to the beam to decrease the deflection.

Analysis may also be performed through the use of simple calculations based on comparing the magnitude of the load placed on a beam with the distance of the load from a point at which the beam is anchored by a hanger rod assembly 24. Larger loads that are placed further from anchor points would require the attachment of a stiffener 40 for reinforcement.

Returning to FIG. 5, the filter unit 32 is also illustrated in cross section. The filter unit 32 may have retention arms 234 that hold the filter 140 above a diffusion assembly 236. The diffusion assembly 236 has a clip 237, or optionally multiple clips, coupled to the lateral groove 60 of the second side 66 of the first main beam 20. The diffusion assembly 236 also has a diffusion panel 238 attached to the clip 237 via a fastener 239. The diffusion panel 238 lies generally flush with the underside of the first main beam 20, and operates to diffuse filtered air from the filter 140 into the clean room envelope for ventilation. As mentioned previously, the filter unit 32 may include other structures known in the art, and therefore omitted from the present disclosure.

FIG. 5 also illustrates a closure 240 disposed in the bottom nut slot 54. The closure 240 may be formed of a plastic material so that the closure 240 can be easily snapped into or out of the bottom nut slot. The closure 240 permits the bottom nut slot 54 to be covered when not in use for aesthetic purposes.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A sealable ceiling assembly comprising:

a main beam comprising a first side having a receiving feature;

a cross beam comprising a first end; and a first coupling member attachable to the first end, wherein the first coupling member comprises an engagement feature shaped to be translated into the receiving feature and subsequently rotated to interlock with the receiving feature to restrict withdrawal of the first end from the first side; and a resilient member associated with the first coupling member disposed to urge withdrawal of the first coupling member from the first end.

2. The sealable ceiling assembly of claim 1, wherein the main beam comprises a top nut slot disposed to receive a plurality of hanger rods to suspend the main beam from a support ceiling, and a bottom nut slot disposed to facilitate suspension of structures below the main beam.

3. The sealable ceiling assembly of claim 2, further comprising a stiffener comprising an attachment portion attached to the top nut slot, the stiffener further comprising a support web extending transversely from the attachment portion to resist transverse bending of the main beam.

4. The sealable ceiling assembly of claim 1, wherein the receiving feature comprises a retention slot having inwardly extending lips shaped to retain the engagement feature in response to rotation of the engagement feature within the retention slot.

5. The sealable ceiling assembly of claim 4, wherein the engagement feature comprises a head comprising a cam surface shaped to permit rotation of the head within the retention slot between a disengaged orientation in which the head can be translated out of the receiving feature and an engaged orientation in which withdrawal of the head is blocked by the inwardly extending lips.

6. The sealable ceiling assembly of claim 5, wherein the engaged and disengaged orientations are separated by an angular displacement of about ninety degrees.

7. The sealable ceiling assembly of claim 1, wherein the first coupling member comprises a tightening feature disposed to urge retraction of the first coupling member with respect to the first end of the cross beam to tighten the first end against the first side of the main beam in response to actuation of the tightening feature.

8. The sealable ceiling assembly of claim 1, wherein the cross beam further comprises a second end, the ceiling assembly further comprising a second coupling member attachable to the second end, wherein the second coupling member is translatable and rotatable in tandem with rotation of the first coupling member to interlock with a receiving feature of a second main beam to restrict withdrawal of the second end from the second main beam.

9. The sealable ceiling assembly of claim 1, further comprising a plurality of structures selected from the group consisting of air diffusion panels, blank panels, and light fixtures disposed in spaces adjacent to the main beam and the cross beam and substantially sealed against the main and cross beams to enable maintenance of a clean room environment underneath the sealable ceiling assembly.

10. A cross beam assembly for a sealable ceiling assembly, the cross beam assembly comprising:

a cross beam comprising a first end; and a coupling member slidably coupled to the first end, the coupling member comprising an engagement feature disposable to interlock with a main beam, and a tightening feature disposed to urge retraction of the coupling member with respect to the first end of the cross beam to tighten the first end against the main beam in response to actuation of the tightening feature; and a resilient member associated with the first coupling member disposed to urge withdrawal of the coupling member from the first end with a force small enough to be overcome by actuation of the tightening feature.

11. The cross beam assembly of claim 10, wherein the cross beam further comprises a bore within which the coupling member is slidably disposed such that the engagement feature protrudes from the bore.

12. The cross beam assembly of claim 10, wherein the receiving feature comprises a retention slot having inwardly extending lips shaped to retain the engagement feature in response to rotation of the engagement feature within the retention slot over an angular displacement of about ninety degrees.

13. The cross beam assembly of claim 10, wherein the first end of the cross beam comprises a generally conical countersink, wherein the tightening feature comprises a set screw having a generally conical end insertable into the generally conical countersink to attach the coupling member to the first end of the cross beam and to urge retraction of the coupling member with respect to the first end.

14. The cross beam assembly of claim 10, further comprising a spacer attached to the first end such that, in response to actuation of the tightening feature, the spacer presses against a grip feature of the main beam to restrain rotation of the cross beam relative to the main beam, thereby restraining withdrawal of the engagement feature from the main beam.

15. A coupling member for attaching a cross beam to a main beam to construct a sealable ceiling assembly, the coupling member comprising:

a head comprising a cam surface shaped to permit rotation of the head within a receiving feature of the main beam, between a disengaged orientation in which the head can be translated out of the receiving feature and an engaged orientation in which the head cannot be translated out of the receiving feature;

a set screw movable to press against the cross beam to draw the cross beam toward the main beam when the head is engaged by the receiving feature; and a resilient member associated with the first coupling member disposed to urge withdrawal of the coupling member from the cross beam with a force small enough to be overcome by actuation of the set screw.

16. The coupling member of claim 15, wherein the set screw comprises a generally conical end insertable into a generally conical countersink formed in the cross beam to attach the coupling member to the cross beam and to urge retraction of the coupling member with respect to the cross beam.

17. A sealable ceiling assembly comprising:

a main beam comprising a first side having a receiving feature with an insertion portion;

a cross beam comprising a first end; and a first coupling member attachable to the first end, wherein the first coupling member comprises an engagement feature shaped to be translated into the receiving feature via the insertion portion and subsequently moved away from the insertion portion to interlock with the receiving feature to restrict withdrawal of the first end from the first side; and a resilient member associated with the first coupling member disposed to urge withdrawal of the first coupling member from the first end.

18. The sealable ceiling assembly of claim 17, wherein the receiving feature comprises a retention slot having inwardly extending lips shaped to retain the engagement feature, wherein the inwardly extending lips diverge at the insertion portion to permit passage of the engagement feature through the insertion portion.

19. The sealable ceiling assembly of claim 18, wherein the inwardly extending lips define a keyhole at the insertion portion.

20. The sealable ceiling assembly of claim 17, wherein the first coupling member comprises a tightening feature disposed to urge retraction of the first coupling member with respect to the first end of the cross beam to tighten the first end against the first side of the main beam in response to actuation of the tightening feature.

* * * * *